US010047318B2

(12) United States Patent
Vial et al.

(10) Patent No.: US 10,047,318 B2
(45) Date of Patent: Aug. 14, 2018

(54) OSMANTHUS ODORANT

(71) Applicant: Firmenich SA, Geneva (CH)

(72) Inventors: Christian Vial, Eloise (FR); Lionel Saudan, Geneva (CH)

(73) Assignee: Firmenich SA, Geneva (CH)

( * ) Notice: Subject to any disclaimer, the term of this patent is extended or adjusted under 35 U.S.C. 154(b) by 0 days.

(21) Appl. No.: 15/567,449

(22) PCT Filed: Apr. 12, 2016

(86) PCT No.: PCT/EP2016/057970

§ 371 (c)(1),
(2) Date: Oct. 18, 2017

(87) PCT Pub. No.: WO2016/169802

PCT Pub. Date: Oct. 27, 2016

(65) Prior Publication Data

US 2018/0105765 A1 Apr. 19, 2018

(30) Foreign Application Priority Data

Apr. 23, 2015 (EP) ..... 15164862

(51) Int. Cl.
*C11B 9/00* (2006.01)

(52) U.S. Cl.
CPC ..... *C11B 9/0015* (2013.01); *C11B 9/0034* (2013.01); *C11B 9/0073* (2013.01)

(58) Field of Classification Search
CPC ..... C11B 9/0015
See application file for complete search history.

(56) References Cited

U.S. PATENT DOCUMENTS 4,396,670 A 8/1983 Sinclair
4,482,762 A * 11/1984 Kaiser et al.
4,585,662 A * 4/1986 Kaiser et al.
4,948,781 A * 8/1990 Kaiser et al.
2009/0092725 A1 4/2009 Panten et al.

FOREIGN PATENT DOCUMENTS

WO WO2001041915 A1 6/2001

OTHER PUBLICATIONS

International Preliminary Report on Patentability, Appl. No. PCT/EP2016/057970, dated Oct. 24, 2017.
International Search Report and Written Opinion, application PCT/EP2016/057970 dated Jun. 2, 2016.
Bone et al., "Microencapsulated Fragrances in Melamine Formaldehyde Resins", Chimia, 2011, vol. 65, n° 3, pp. 177-181.
Dietrich et al., "Amino Resin Microcapsules. 1. Literature and patent review", Acta Polymerica, 1989, vol. 40, pp. 243-251.
Dietrich et al., "Amino Resin Microcapsules. II. Preparation and morphology", Acta Polymerica, 1989, vol. 40, pp. 325-331.
Dietrich et al., "Amino Resin Microcapsules. III. Release properties", Acta Polymerica, 1989, vol. 40, pp. 683-690.
Dietrich et al., "Amino Resin Microcapsules. IV. Surface tension of the resins and mechanism of capsule formation", Acta Polymerica, 1990, vol. 41, n° 2, pp. 91-95.
Herrmann, "Controlled release of volatiles under mild reaction conditions: from nature to everyday products", Angew. Chem. Int. Ed. 2007, vol. 46, pp. 5836-5863.
Lee et al., "Microencapsulation of fragrant oil via in situ polymerization: effects of pH and melamine-formaldehyde molar ratio", J. Microencapsulation, 2002, vol. 19, 559-569.

* cited by examiner

*Primary Examiner* — Arrie L Reuther
(74) *Attorney, Agent, or Firm* — Winston & Strawn LLP

(57) ABSTRACT

The present invention concerns the use as perfuming ingredient of a composition of matter comprising at least 94% w/w of 4,6-dimethyl-3-octen-5-ol, and at most 1% w/w of 2-methylpent-2-en-1-ol and 3-ethyl-4-methylhexan-2-one.

11 Claims, No Drawings

OSMANTHUS ODORANT

RELATED APPLICATIONS

This application is a national stage application under 35 U.S.C. § 371 filing of International Patent Application PCT/EP2016/057970, filed Apr. 12, 2016, which claims the benefit of European patent application n° 15164862.3 filed Apr. 23, 2015.

TECHNICAL FIELD

The present invention relates to the field of perfumery. More particularly, it concerns the use as perfuming ingredient of a composition of matter comprising at least 94% w/w of 4,6-dimethyl-3-octen-5-ol, and at most 1% w/w of 2-methylpent-2-en-1-ol and 3-ethyl-4-methylhexan-2-one.

Therefore, following what is mentioned herein, the present invention comprises the invention's compound as part of a perfuming composition or of a perfuming consumer product.

BACKGROUND

To the best of our knowledge, the 4,6-dimethyl-3-octen-5-ol is mentioned only in one document. In said document, U.S. Pat. No. 4,585,662, 4,6-dimethyl-3-octen-5-ol is described as having a green herbal odor, i.e. an odor totally different from the one of the present invention's composition of matter. However, although this document reports a pure compound, in fact the product obtained is a composition of matter comprising at least three different chemicals ingredients.

This document does not report or suggest any organoleptic properties of the invention's composition of matter, and its associated uses.

DESCRIPTION OF THE INVENTION

We have now surprisingly discovered that a composition of matter comprising at least 94% w/w of formula (I)

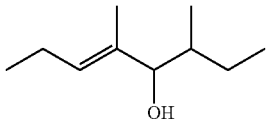

in the form of any one of its stereoisomers or a mixture thereof; and at most 1% w/w of 2-methylpent-2-en-1-ol and 3-ethyl-4-methylhexan-2-one wherein the percentages are expressed in a weight to weight basis relative to the total weight of said composition of matter;

can be used as perfuming ingredient, for instance to impart odor notes of the osmanthus type.

For the sake of clarity, by the expression "any one of its stereoisomers", or the similar, it is meant the normal meaning understood by a person skilled in the art, i.e. that the invention's compound can be a pure enantiomer (if chiral) or diastereomer (e.g. the double bond is in a conformation E or Z, or the substituents of the main chain can be in a syn or anti configuration).

For the sake of clarity, by the expression "composition of matter", or the similar, it is meant the normal meaning understood by a person skilled in the art, i.e. that at least two different compounds (which are not stereoisomers) are present. According to any one of the above embodiments of the invention, and as non-limiting examples such compound (I) can be present up to 99.0% w/w, or even 99.5% w/w or 99.9% w/w, or even 99.95% w/w, of the composition of matter.

According to any one of the above embodiments of the invention, said compound (I) can be in the form of its E or Z isomer or of a mixture thereof, e.g. the invention comprises compositions of matter comprising, or even consisting of, one or more compounds of formula (I), having the same chemical structure but differing by the configuration of the double bond. In particular, compound (I) can be in the form of a mixture comprising, or even consisting of, isomers E and Z and wherein said isomers E represent at least 90% of the total mixture, or even at least 95% (i.e a mixture E/Z comprised between 95/5 and 100/0).

According to any embodiment of the invention, said composition of matter comprises at least 95% w/w of formula (I); and at most 0.8% w/w of 2-methylpent-2-en-1-ol and 3-ethyl-4-methylhexan-2-one.

According to any embodiment of the invention, said composition of matter comprises at most 0.6% w/w, or even 0.3% w/w, of 2-methylpent-2-en-1-ol and 3-ethyl-4-methylhexan-2-one.

In particular one may cite a composition of matter comprising between 96% and 99% w/w E-4,6-dimethyl-3-octen-5-ol and less than 0.5% w/w of 2-methylpent-2-en-1-ol and 3-ethyl-4-methylhexan-2-one.

As specific examples of the invention's composition of matter, one may cite, as non-limiting example, a composition comprising about 96% w/w 4,6-dimethyl-3-octen-5-ol (e.g. as an essentially pure E isomer and a syn/anti 48:52 mixture of diastereoisomers) and less than 0.5% w/w of 2-methylpent-2-en-1-ol and 3-ethyl-4-methylhexan-2-one. Said composition of matter is characterized by an odor reminding strongly of the osmanthus flowers, i.e. a floral green, fruity (apricot) note. To the best of our knowledge, it is quite rare to have an odor strongly reminiscent of osmanthus (a very much appreciated Asian flower) without recurring to complex formulations.

One may cite, as non-limiting example, a composition comprising about 98% pure syn-4,6-dimethyl-3-octen-5-ol (e.g. as an essentially pure E isomer) and less than 0.5% w/w of 2-methylpent-2-en-1-ol and 3-ethyl-4-methylhexan-2-one. Said composition of matter is characterized by having also a linalool note compared to the above composition of matter.

One may cite, as non-limiting example, a composition comprising about 99.5% pure anti-4,6-dimethyl-3-octen-5-ol (e.g. as an essentially pure E isomer) and less than 0.3% w/w of 2-methylpent-2-en-1-ol and 3-ethyl-4-methylhexan-2-one. Said composition of matter, compared with the first example describe herein above, is characterized by a stronger fruity, apricot character. According to any embodiment of the invention, a composition of matter comprising compound (I) as a mixture of predominantly (i.e. having a ration anti/syn above 1) the anti stereoisomer is particularly appreciated.

The present invention's composition of matter is characterized by having only very limited amounts of 2-methylpent-2-en-1-ol and 3-ethyl-4-methylhexan-2-one. Indeed we surprisingly found that these two compounds, can alter or even erase the olfactive character of the composition of matter if present in more than traces. In particular 2-methylpent-2-en-1-ol is characterized by an extremely potent amylic, green note while 3-ethyl-4-methylhexan-2-one is characterized by an extremely potent pyrazine, earthy note. We noticed that the prior art disclosure of compound (I) use a synthetic method which can provide a composition of matter containing more that 2% of these two compounds.

The end result is that the prior art discloses a different composition of matter having very different odor properties. Indeed, when the odor of the invention's composition of matter is compared with that described in the prior art for compound (I), then the invention's composition of matter distinguish themselves by having a clear osmanthus, fruity character totally absent from the prior art description for the $C_{10}$ compounds. The odor of the invention's compounds is also lacking, or not possessing significant, green-herbal notes, which are characteristic of the prior art description. Said differences lend the invention's compounds and the prior art compounds to be each suitable for different uses, i.e. to impart different organoleptic impressions.

As mentioned above, the invention concerns the use of an invention's composition of matter as perfuming ingredient. In other words, it concerns a method to confer, enhance, improve or modify the odor properties of a perfuming composition or of a perfumed article, which method comprises adding to said composition or article an effective amount of an invention's composition of matter. By "use of an invention's composition of matter" it has to be understood here also the use of any composition containing an invention's composition of matter and which can be advantageously employed in perfumery industry.

According to any embodiment of the invention, said method confers, imparts enhances, improves or modifies the odor notes of the osmanthus type.

The novel and inventive compositions including the above-mentioned composition of matter in fact can be advantageously employed as perfuming ingredients and are also an object of the present invention.

Therefore, another object of the present invention is a perfuming composition comprising:

i) as perfuming ingredient, an invention's composition of matter as defined above;
ii) at least one ingredient selected from the group consisting of a perfumery carrier and a perfumery base; and
iii) optionally at least one perfumery adjuvant.

According to any embodiment of the invention, said perfuming composition comprises at least a perfumery base.

By "perfumery carrier" we mean here a material which is practically neutral from a perfumery point of view, i.e. that does not significantly alter the organoleptic properties of perfuming ingredients. Said carrier may be a liquid or a solid.

As liquid carrier one may cite, as non-limiting examples, an emulsifying system, i.e. a solvent and a surfactant system, or a solvent commonly used in perfumery. A detailed description of the nature and type of solvents commonly used in perfumery cannot be exhaustive. However, one can cite as non-limiting examples solvents such as butylene or propylene glycols, glycerol, dipropyleneglycol and its monoether, 1,2,3-propanetriyl triacetate, dimethyl glutarate, dimethyl adipate 1,3-diacetyloxypropan-2-yl acetate, diethyl phthalate, isopropyl myristate, benzyl benzoate, benzyl alcohol, 2-(2-ethoxyethoxy)-1-ethano, tri-ethyl citrate or mixtures thereof, which are the most commonly used. For the compositions which comprise both a perfumery carrier and a perfumery base, other suitable perfumery carriers than those previously specified, can be also ethanol, water/ethanol mixtures, limonene or other terpenes, isoparaffins such as those known under the trademark Isopar® (origin: Exxon Chemical) or glycol ethers and glycol ether esters such as those known under the trademark Dowanol® (origin: Dow Chemical Company), or hydrogenated castors oils such as those known under the trademark Cremophor® RH 40 (origin: BASF).

As solid carrier it is meant a material where the perfuming composition or some element of the perfuming composition can be chemically or physically bound. In general such solid carriers are employed either to stabilize the composition, either to control the rate of evaporation of the compositions or of some ingredients. The employment of solid carriers is of current use in the art and a person skilled in the art knows how to reach the desired effect. However by way of non-limiting example as solid carriers one may cite absorbing gums or polymers or inorganic material, such as porous polymers, cyclodextrines, wood based materials, organic or inorganic gels, clays, gypsum talc or zeolites.

As other non-limiting example of solid carrier one may cite encapsulating materials. Examples of such materials may comprise wall-forming and plasticizing materials, such as mono, di- or trisaccharides, natural or modified starches, hydrocolloids, cellulose derivatives, polyvinyl acetates, polyvinylalcohols, proteins or pectins, or yet the materials cited in reference texts such as H. Scherz, Hydrokolloide: Stabilisatoren, Dickungs- and Geliermittel in Lebensmitteln, Band 2 der Schriftenreihe Lebensmittelchemie, Lebensmittelqualität, Behr's Verlag GmbH & Co., Hamburg, 1996. The encapsulation is a well-known process to a person skilled in the art, and may be performed, for instance, using techniques such as spray-drying, agglomeration or yet extrusion; or consists of a coating encapsulation, including coacervation and complex coacervation technique. As non-limiting examples one may cite in particular the core-shell encapsulation with resins of the aminoplast, polyamide, polyester, polyurea or polyurethane type or a mixture thereof (all of said resins are well known to a person skilled in the art) using techniques like phase separation process induced by polymerization, by interfacial polymerization, by coacervation or altogether (all of said techniques have been described in the prior art), and optionally in the presence of polymeric stabilizer or a cationic copolymer.

In particular, as resins one may cite the ones produced by the polycondensation of an aldehyde (e.g. formaldehyde, 2,2-dimethoxyethanal, glyoxal, glyoxylic acid or glycolaldehyde and mixtures thereof) with an amine, namely urea, benzoguanamine, glycoluryl, melamine, methylol melamine, methylated methylol melamine, guanazole and the like, as well as mixtures thereof. Alternatively one may use preformed resins alkylolated polyamines such as those commercially available under the trademark Urac® (origin: Cytec Technology Corp.), Cy Mel® (origin: Cytec Technology Corp.), Urecoll® or Luracoll® (origin: BASF).

In particular, as resins one may cite the ones produced by the polycondensation of a polyol, like glycerol, and a polyisocyanate, like a trimer of hexamethylene diisocyanate, a trimer of isophorone diisocyanate or xylylene diisocyanate or a Biuret of hexamethylene diisocyanate or a trimer of xylylene diisocyanate with trimethylolpropane (known with the tradename of Takenate®, origin: Mitsui Chemicals), among which a trimer of xylylene diisocyanate with trimethylolpropane and a Biuret of hexamethylene diisocyanate.

Some of the seminal literature related to the encapsulation of perfumes by polycondensation of amino resins, namely melamine based resins, with aldehydes is represented by articles such as those published by K. Dietrich et al. in Acta Polymerica, 1989, vol. 40, pages 243, 325 and 683, as well as 1990, vol. 41, page 91. Such articles already describe the various parameters affecting the preparation of such core-shell microcapsules following prior art methods that are also further detailed and exemplified in the patent literature. U.S. Pat. No. 4,396,670, to the Wiggins Teape Group Limited is a pertinent early example of the latter. Since then, many other authors and creators have enriched the literature in this field and it would be impossible to cover all published developments here, but the general knowledge in this type of encapsulation is very significant. More recent publications of pertinence, which also address suitable uses of such microcapsules, are represented for example by the article of H. Y. Lee et al. in Journal of Microencapsulation, 2002, vol. 19, pages 559-569, international patent publication WO 01/41915 or yet the article of S. Bone et al. in Chimia, 2011, vol. 65, pages 177-181.

By "perfumery base" we mean here a composition comprising at least one perfuming co-ingredient.

Said perfuming co-ingredient is not an invention's composition of matter. Moreover, by "perfuming co-ingredient" it is meant here a compound, which is used in a perfuming preparation or a composition to impart a hedonic effect. In other words such a co-ingredient, to be considered as being a perfuming one, must be recognized by a person skilled in the art as being able to impart or modify in a positive or pleasant way the odor of a composition, and not just as having an odor.

According to any embodiment of the invention, said perfuming composition comprises at least a perfumery base comprising at least two, three, four perfuming co-ingredients, as for example any combination of the ones herein below cited. In particular said perfuming composition can be of the floral and/or fruity type.

The nature and type of the perfuming co-ingredients present in the base do not warrant a more detailed description here, which in any case would not be exhaustive, the skilled person being able to select them on the basis of his general knowledge and according to intended use or application and the desired organoleptic effect. In general terms, these perfuming co-ingredients belong to chemical classes as varied as alcohols, lactones, aldehydes, ketones, esters, ethers, acetates, nitriles, terpenoids, nitrogenous or sulphurous heterocyclic compounds and essential oils, and said perfuming co-ingredients can be of natural or synthetic origin or even pro-perfumes (i.e. compounds which upon degradation liberate a perfuming ingredient). Examples of pro-perfumes have been described in the literature such as in the article published by A. Herrmann in Angewandte Chemie International Edition, 2007, vol. 46, p. 5836-5863 or in more recent work of similar type, as well as in the abundant patent literature in the field.

According to any embodiment of the invention, as perfuming co-ingredients one may cite in particular the perfuming lactones, e.g. $C_{5-12}$ monocyclic lactones, in particular gamma lactones. As non-limiting examples of perfuming lactones one may cite gamma nonalactone, gamma decalactone, gamma undecalactone and gamma dodecalactone. In particular, said lactones can be advantageously admixed in a w/w ratio (invention's composition of matter/lactones) comprised between 2/1 and 1/20, or even between 1/1 and 1/10. Indeed the invention's composition of matter showed an interesting synergies with perfuming lactones and hided the fatty aspects of said lactones.

According to any embodiment of the invention, as perfuming co-ingredients one may cite in particular also the ionone. By ionone it is here meant the usal meaning in the art, and this term includes alpha or beta ionone, a methyl ionone and alpha or beta di-hydro ionone. According to any embodiment of the invention, said ionone is selected amongst alpha or beta ionone and alpha or beta di-hydro ionone.

In particular, said ionones can be advantageously admixed in a w/w ratio (invention's composition of matter/ionones) comprised between 2/1 and 1/10, or even between 1/1 and 1/4. Indeed the invention's composition of matter showed an interesting synergies with ionones and hided the dry aspects of the said perfuming co-ingredients.

Consequently, and according to any embodiment of the invention, a perfuming composition comprising the composition of matter (I) and at least one of the above lactones and/or ionones is also an object of the present invention.

Furthermore, in addition to the one above, one may also cite perfuming co-ingredients which are commonly used in perfume formulations, such as:

- Aldehydic ingredients: decanal, dodecanal, 2-methyl-undecanal, 10-undecenal, octanal and/or nonenal;
- Aromatic-herbal ingredients: eucalyptus oil, camphor, eucalyptol, menthol and/or alpha-pinene;
- Balsamic ingredients: coumarine, ethylvanillin and/or vanillin;
- Citrus ingredients: dihydromyrcenol, citral, orange oil, linalyl acetate, citronellyl nitrile, orange terpenes, limonene, 1-P-menthen-8-yl acetate and/or 1,4(8)-P-menthadiene;
- Floral ingredients: Methyl dihydrojasmonate, linalool, Citronellol, phenylethanol, 3-(4-tert-butylphenyl)-2-methylpropanal, hexylcinnamic aldehyde, benzyl acetate, benzyl salicylate, tetrahydro-2-isobutyl-4-methyl-4(2H)-pyranol, beta ionone, methyl 2-(methylamino)benzoate, (E)-3-methyl-4-(2,6,6-trimethyl-2-cyclohexen-1-yl)-3-buten-2-one, hexyl salicylate, 3,7-dimethyl-1,6-nonadien-3-ol, 3-(4-isopropylphenyl)-2-methylpropanal, verdyl acetate, geraniol, P-menth-1-en-8-ol, 4-(1,1-dimethylethyl)-1-cyclohexyle acetate, 1,1-dimethyl-2-phenylethyl acetate, 4-cyclohexyl-2-methyl-2-butanol, amyl salicylate, high cis methyl dihydrojasmonate, 3-methyl-5-phenyl-1-pentanol, verdyl proprionate, geranyl acetate, tetrahydro linalool, cis-7-P-menthanol, Propyl (S)-2-(1,1-dimethylpropoxy)propanoate, 2-methoxynaphthalene, 2,2,2-trichloro-1-phenylethyl acetate, 4/3-(4-hydroxy-4-methylpentyl)-3-cyclohexene-1-carbaldehyde, amylcinnamic aldehyde, 4-phenyl-2-butanone, isononyle acetate, 4-(1,1-diméthyléthyl)-1-cyclohexyl acetate, verdyl isobutyrate and/or mixture of methylionones isomers;
- Fruity ingredients: gamma undecalactone, 4-decanolide, ethyl 2-methyl-pentanoate, hexyl acetate, ethyl 2-methylbutanoate, gamma nonalactone, allyl heptanoate, 2-phenoxyethyl isobutyrate, ethyl 2-methyl-1,3-dioxolane-2-acetate and/or diethyl 1,4-cyclohexane dicarboxylate;
- Green ingredients: 2,4-Dimethyl-3-cyclohexene-1-carbaldehyde, 2-tert-butyl-1-cyclohexyl acetate, styrallyl acetate, allyl (2-methylbutoxy)acetate, 4-methyl-3-decen-5-ol, diphenyl ether, (Z)-3-hexen-1-ol and/or 1-(5,5-dimethyl-1-cyclohexen-1-yl)-4-penten-1-one;
- Musk ingredients: 1,4-dioxa-5,17-cycloheptadecanedione, pentadecenolide, 3-Methyl-5-cyclopentadecen-1-one, 1,3,4,6,7,8-hexahydro-4,6,6,7,8,8-hexamethylcyclopenta-[G]isochromene, (1S,1'R)-2-[1-(3',3'-dimethyl-1'-cyclohexyl)ethoxy]-2-methylpropyl propanoate, and/or (1S,1'R)-[1-(3',3'-Dimethyl-1'-cyclohexyl)ethoxycarbonyl]methyl propanoate;

Woody ingredients: 1-(octahydro-2,3,8,8-tetramethyl-2-naphthalenyl)-1-ethanone, patchouli oil, terpenes fractions of patchouli oil, (1'R,E)-2-ethyl-4-(2',2',3'-trimethyl-3'-cyclopenten-1'-yl)-2-buten-1-ol, 2-ethyl-4-(2,2,3-trimethyl-3-cyclopenten-1-yl)-2-buten-1-ol, Methyl cedryl ketone, 5-(2,2,3-trimethyl-3-cyclopentenyl)-3-methylpentan-2-ol, 1-(2,3,8,8-tetramethyl-1,2,3,4,6,7,8,8a-octahydronaphthalen-2-yl)ethan-1-one and/or isobornyl acetate;

Other ingredients (e.g. amber, powdery spicy or watery): dodecahydro-3a,6,6,9a-tetramethyl-naphtho[2,1-b] furan and any of its stereoisomers, heliotropin, anisic aldehyde, eugenol, cinnamic aldehyde, clove oil, 3-(1,3-benzodioxol-5-yl)-2-methylpropanal and/or 3-(3-isopropyl-1-phenyl)butanal.

A perfumery base according to the invention may not be limited to the above mentioned perfuming co-ingredients, and many other of these co-ingredients are in any case listed in reference texts such as the book by S. Arctander, Perfume and Flavor Chemicals, 1969, Montclair, N.J., USA, or its more recent versions, or in other works of a similar nature, as well as in the abundant patent literature in the field of perfumery. It is also understood that said co-ingredients may also be compounds known to release in a controlled manner various types of perfuming compounds.

By "perfumery adjuvant" we mean here an ingredient capable of imparting additional added benefit such as a color, a particular light resistance, chemical stability, etc. A detailed description of the nature and type of adjuvant commonly used in perfuming bases cannot be exhaustive, but it has to be mentioned that said ingredients are well known to a person skilled in the art. However, one may cite as specific non-limiting examples the following: viscosity agents (e.g. surfactants, thickeners, gelling and/or rheology modifiers), stabilizing agents (e.g. preservatives, antioxidant, heat/light and or buffers or chelating agents, such as BHT), color agents (e.g. dyes and/or pigments), preservative (e.g. antibacterial or antimicrobial or antifungi or anti irritant agents), abrasives, skin cooling agents, fixatives, insect repellants, ointments, vitamins and mixture thereof.

It is understood that a person skilled in the art is perfectly able to design optimal formulations for the desired effect by admixing the above-mentioned components of a perfuming composition, simply by applying the standard knowledge of the art as well as by trial and error methodologies.

An invention's composition consisting of at least one compound of formula (I) and at least one perfumery carrier represents a particular embodiment of the invention as well as a perfuming composition comprising at least one compound of formula (I), at least one perfumery carrier, at least one perfumery base, and optionally at least one perfumery adjuvant.

For the sake of clarity, it is also understood that any mixture resulting directly from a chemical synthesis, e.g. a reaction medium without an adequate purification, in which the composition of matter of the invention would be involved as a starting, intermediate or end-product could not be considered as a perfuming composition according to the invention as far as said mixture does not provide the inventive composition of matter in a suitable form for perfumery.

Furthermore, the invention's composition of matter can also be advantageously used in all the fields of modern perfumery, i.e. fine or functional perfumery, to positively impart or modify the odor of a consumer product into which said composition of matter is added. Consequently, another object of the present invention is represented by a perfuming consumer product comprising, as perfuming ingredient, an invention's composition of matter, as defined above.

The invention's composition of matter can be added as such or as part of an invention's perfuming composition.

For the sake of clarity, it has to be mentioned that, by "perfuming consumer product" it is meant a consumer product which is expected to deliver at least a pleasant perfuming effect to the surface to which it is applied (e.g. skin, hair, textile, or home surface). In other words, a perfuming consumer product according to the invention is a perfumed consumer product which comprises the functional formulation, as well as optionally additional benefit agents, corresponding to the desired consumer product, e.g. a detergent or an air freshener, and an olfactive effective amount of an invention's composition of matter. For the sake of clarity, said perfuming consumer product is a non-edible product.

The nature and type of the constituents of the perfumery consumer product do not warrant a more detailed description here, which in any case would not be exhaustive, the skilled person being able to select them on the basis of his general knowledge and according to the nature and the desired effect of said product.

Non-limiting examples of suitable perfuming consumer product can be a perfume, such as a fine perfume, a splash or eau de perfume, a cologne or a shave or after-shave lotion; a fabric care product, such as a liquid or solid detergent, a fabric softener, a fabric refresher, an ironing water, a paper, or a bleach, carpet cleaners, curtain-care products; a body-care product, such as a hair care product (e.g. a shampoo, a coloring preparation or a hair spray, a color care product, hair shaping product, a dental care product), a disinfectant, an intimate care product; a cosmetic preparation (e.g. a skin cream or lotion, a vanishing cream or a deodorant or antiperspirant (e.g. a spray or roll on), hair remover, tanning or sun or after sun product, nail products, skin cleansing, a makeup); or a skin-care product (e.g. a perfumed soap, shower or bath mousse, oil or gel, or a hygiene product or a foot/hand care products); an air care product, such as an air freshener or a "ready to use" powdered air freshener which can be used in the home space (rooms, refrigerators, cupboards, shoes or car) and/or in a public space (halls, hotels, malls, etc.); or a home care product, such as a mold remover, furnisher care, wipe, a dish detergent or hard-surface (e.g. a floor, bath, sanitary or a windows) detergent; a leather care product; a car care product, such as a polish, waxes or plastic cleaners.

Some of the above-mentioned consumer product may represent an aggressive medium for the invention's composition of matter, so that it may be necessary to protect the latter from premature decomposition, for example by encapsulation or by chemically bounding it to another chemical which is suitable to release the pure compound (I) upon a suitable external stimulus, such as an enzyme, light, heat or a change of pH.

The proportions in which the composition of matter according to the invention can be incorporated into the various aforementioned articles or compositions vary within a wide range of values. These values are dependent on the nature of the article to be perfumed and on the desired organoleptic effect as well as the nature of the co-ingredients in a given base when the composition of matter according to the invention is mixed with perfuming co-ingredients, solvents or additives commonly used in the art.

For example, in the case of perfuming compositions, typical concentrations are in the order of 0.01% to 10% by weight, or even more, of the composition of matter of the invention based on the weight of the composition into which they are incorporated. Concentrations lower than these, such as in the order of 0.001% to 4% by weight, can be used when these composition of matter are incorporated into perfumed articles, percentage being relative to the weight of the article.

The invention's composition of matter are obtainable according to a method as described herein below, e.g. by adding sec-butyl-magnesium bromide over 2-methyl-2-pentenal, and then purifying the crude product with a suitable method (e.g. chromatography or efficient fractional distillation) in order to remove as much as possible of the undesired compounds (i.e. 2-methylpent-2-en-1-ol and 3-ethyl-4-methylhexan-2-one) which are formed as by-product.

EXAMPLES

The invention will now be described in further detail by way of the following examples, wherein the abbreviations have the usual meaning in the art, the temperatures are indicated in degrees centigrade (° C.); the NMR spectral data were recorded in $CDCl_3$ (if not stated otherwise) with a 400 or 500 MHz machine for $^1H$ and $^{13}C$, the chemical shifts δ are indicated in ppm with respect to TMS as standard, the coupling constants J are expressed in Hz.

Example 1

Synthesis of Compounds of Formula (I)

Composition 1:

To an ice-cooled solution of 17.5 g (178 mmole) of freshly distilled 2-methyl-2-pentenal in diethyl ether (270 ml) was added dropwise 180 ml (180 mmole) of 1M sec-butyl-magnesium bromide in THF. After 30 minutes at 0° and 1 hour at room temperature, the reaction mixture was poured into 200 ml of ice-cooled saturated $NH_4Cl$ and the pH was adjusted to 1 with concentrated HCl. After usual treatment and evaporation of the solvent (Rotavapor), the crude alcohol (33.2 g) was distilled using a Fischer column ($Eb_{(10\ mbars)}$=82-84° to furnished 19.6 g (yield=70.3%) of a composition of matter comprising about 96% w/w pure E-4,6-dimethyl-3-octen-5-ol as a 48:52 mixture of stereoisomers (syn and anti stereoisomers the separation is only visible on polar GC column) and less than 0.5% w/w of 2-methylpent-2-en-1-ol and 3-ethyl-4-methylhexan-2-one.

$^1$H-NMR: 0.72-1.00 (4t+2d, 9H), 1.00-2.10 (m, 5H), 1.57 and 1.59 (2s, 3H), 3.54 and 3.62 (2d, J=8, 1H), 5.35 (m, 1H).

$^{13}$C-NMR: 10.9 (q), 11.2 (q), 11.5 (q), 11.7 (q), 14.0 (q), 14.1 (q), 14.3 (q), 15.5(q), 20.8 (t), 20.8 (t), 24.9 (t), 26.1 (t), 37.4 (d), 37.5 (d), 81.8 (d), 82.7 (d), 128.9 (d), 129.8 (d), 135.7 (s), 135.8 (s).

Composition 2:

Step a) mainly anti-(E)-3,5-dimethylocta-1,5-dien-4-ol:

A solution of 2-methyl pentenal (1.0324 g, 10.5 mmoles) in $CH_2Cl_2$ (2 ml) was added dropwise to a cold (−78° C.) solution of trans-crotyl pinacolboronic ester (1.919 g, 10.5 mmoles) in $CH_2Cl_2$ (5 ml). More $CH_2Cl_2$ (3×1 ml) was added to rinse. After 2 h45 min, the cooling bath was removed and the solution was stirred at room temperature for 36 h. Then a solution of triethanolamine (1.582 g, 10.6 mmol) in $CH_2Cl_2$ (4 ml) was added and the solution was stirred for 24 h. After evaporation of the solvent under reduced pressure, the white suspension was filtered over a plug of silica gel eluted with $CH_2Cl_2$ to give the desired product as a colorless liquid (1.539 g, 9.98 mmol).

$^1$H NMR: 5.75 (ddd, J=8.4, 10.2, 17.2, 1H), 5.39 (br t, J=7.0, 1H), 5.15 (dd, 1H), 5.12-5.18 (m, 2H), 3.63 (d, J=8.8, 1H), 2.27-2.35 (m, 1H), 2.06 (quint, J=7.4, 2H), 1.77 (br s, 1H), 1.61 (s, 1H), 0.97 (t, J=7.5, 3H), 0.88 (d, J=6.9, 3H).

$^{13}$C NMR: 141.4 (CH), 134.1 (C), 130.9 (CH), 116.4 ($CH_2$), 81.4 (CH), 42.2 (CH), 20.9 ($CH_2$), 16.8 ($CH_3$), 14.0 ($CH_3$), 10.8 ($CH_3$).

Step b) mainly anti-(E)-4,6-dimethyl-3-octen-5-ol:

A suspension of the above obtained anti-(E)-3,5-dimethylocta-1,5-dien-4-ol (1.617 g, 10.5 mmoles) and Lindlar catalyst (163.3 mg) in cyclohexane (10 ml) was stirred under hydrogen (5 bar) for 2 h. Then the suspension was directly filtered over silica gel and eluted with Pentane/$Et_2O$ (500/1 to 1/1). After evaporation of the solvent, the desired product was obtained as a yellow liquid (1.607 g). Purification by Kugel Rohr distillation, followed by silica gel chromatography (Heptane/AcOEt (5%)/THF (1%) followed by a second Kugel Rohr distillation gave the pure product as a colorless oil (0.934 g, 6 mmoles, yield=57%)

The composition of matter thus obtained contained 99.5% w/w of anti-(E)-4,6-dimethyl-3-octen-5-ol and less than 0.3% w/w of 2-methylpent-2-en-1-ol and 3-ethyl-4-methylhexan-2-one.

$^1$H NMR: 5.34 (t, J=7, 1H), 3.63 (d, J=8.7, 1H), 2.04 (quint, J=7.5, 2H), 1.70-1.78 (m, 1H), 1.58 (pseudo s, 3H), 1.50-1.57 (m, 1H), 1.44 (s, 1H), 1.08-1.16 (m, 1H), 0.96 (t, J=7.5, 3H), 0.91 (t, J=7.5, 3H), 0.73 (d, J=6.8, 3H).

$^{13}$C NMR: 135.8 (C), 129.8 (CH), 82.7 (CH), 37.4 (CH), 24.9 ($CH_2$), 20.8 ($CH_2$), 15.5 ($CH_3$), 14.0 ($CH_3$), 11.2 ($CH_3$), 10.9 ($CH_3$).

Composition 3:

Step a) mainly syn-(E)-3,5-dimethylocta-1,5-dien-4-ol:

A solution of 2-methyl pentenal (1.0439 g, 10.6 mmoles) in $CH_2Cl_2$ (2 ml) was added dropwise to a cold (−78° C.) solution of cis-crotyl pinacolboronic ester (1.943 g, 10.7 mmoles) in $CH_2Cl_2$ (5 ml). More $CH_2Cl_2$ (3×1 ml) was added to rinse. The cooling bath was let warming up to room temperature overnight (15 h) and the solution stirred at room temperature for another 9 h. Then a solution of triethanolamine (1.596 g, 10.7 mmol) in $CH_2Cl_2$ (5 ml) was added and the solution was stirred for 15 h. After evaporation of the solvent under reduced pressure, the white suspension was filtered over a plug of silica gel eluted with $CH_2Cl_2$ to give the desired product as a colorless liquid (1.549 g, 9.82 mmol).

$^1$H NMR: 5.71 (ddd, J=7.2, 10.3, 17.4, 1H), 5.38 (br t, J=7.1, 1H), 5.03 (dt, J=1.5, 14.3, 1H), 4.98 (ddd, J=1.1, 1.7, 10.3, 1H), 3.79 (d, J=7.1, 1H), 2.39 (br sext, J=7 Hz, 1H), 2.03 (quint, J=7.5, 2H), 1.58 (br s, 1H), 1.56 (s, 1H), 1.04 (d, J=6.7, 3H), 0.96 (t, J=7.6, 3H).

$^{13}$C NMR: 141.1 (CH), 135.0 (C), 129.2 (CH), 114.2 ($CH_2$), 80.9 (CH), 41.2 (CH), 20.8 ($CH_2$), 14.9 ($CH_3$), 14.0 ($CH_3$), 11.9 ($CH_3$).

Step b) mainly syn-(E)-4,6-dimethyl-3-octen-5-ol:

A suspension of the above obtained syn-(E)-3,5-dimethylocta-1,5-dien-4-ol (1.323 g, 8.6 mmoles) and Lindlar catalyst (133.8 mg) in cyclohexane (8.5 ml) was stirred under hydrogen (5 bar) for 2 h. Then the suspension was directly filtered over silica gel and eluted with $Et_2O$. After evaporation of the solvent, the desired product was obtained as a yellow liquid (1.362 g). Purification by silica gel chromatography (Heptane/AcOEt (5%)/THF (1%) followed by Kugel Rohr distillation gave the pure product as a colorless oil (0.541 g, 3.5 mmoles, yield=40%).

The composition of matter thus obtained contained 98% w/w of syn-(E)-4,6-dimethyl-3-octen-5-ol and less than 0.5% w/w of 2-methylpent-2-en-1-ol and 3-ethyl-4-methylhexan-2-one.

$^{1}$H NMR: 5.36 (t, J=7.1, 1H), 3.71 (d, J=7.3, 1H), 2.04 (quint, J=7.4, 2H), 1.57 (pseudo s, 3H), 1.49-1.56 (m, 1H), 1.41 (s, 1H), 1.30-1.39 (m, 1H), 1.0-1.07 (m, 1H), 0.97 (t, J=7.5, 3H), 0.92 (d, J=6.7, 3H), 0.89 (t, J=7.4, 3H).

$^{13}$C NMR: 135.8 (C), 128.9 (CH), 81.8 (CH), 37.5 (CH), 26.1 ($CH_2$), 20.8 ($CH_2$), 14.3 ($CH_3$), 14.1 ($CH_3$), 11.65 ($CH_3$), 11.55 ($CH_3$).

Comparative Composition:

Example 8 of U.S. Pat. No. 4,585,662 was reproduced and purified as described in the prior art. Olfactive analysis of the product thus obtained confirmed the olfactive description of the prior art.

GC analysis of the product thus obtained showed that it is a composition comprising:

- at least 96% of E-4,6-dimethyl-3-octen-5-ol as a 1:1 mixture of stereoisomers (syn and anti stereoisomers the separation is only visible on polar GC column);
- about 1.5% w/w of 2-methylpent-2-en-1-ol; and
- about 1.2% w/w of 3-ethyl-4-methylhexan-2-one.

When mentioning "about . . . %" it is understood that it means a value ±0.1.

Example 2

Preparation of a Perfuming Composition

A perfuming composition for a shower gel, of the floral-musky type, was prepared by admixing the following ingredients:

| Parts by weight | Ingredient |
|---|---|
| 20 | Hexyl acetate |
| 25 | Aladinate ®[1)] |
| 500 | Hexylcinnamic aldehyde |
| 200 | Bergamote essential oil |
| 5 | Ethyl caproate |
| 50 | Cetalox ®[2)] |
| 30 | Raspberry ketone |
| 10 | Cis-3-Hexenol |
| 25 | Cis-Jasmone |
| 140 | Coranol ®[3)] |
| 5 | Allyl (cyclohexyloxy)-acetate |
| 10 | Damascone Alpha |
| 200 | Dartanol ®[4)] |
| 200 | Dihydromyrcenol |
| 20 | Ethyl-2-Methylbutyrate |
| 50 | 2-Methyl-4-(2,2,3-trimethyl-3-cyclopenten-1-yl)-4-penten-1-ol |
| 70 | 3-(4/2-Ethylphenyl)-2,2-dimethylpropanal |
| 700 | Habanolide ®[5)] |
| 840 | Hedione ®[6)] |
| 20 | 3-(1,3-benzodioxol-5-yl)-2-methylpropanal |
| 10 | 1,3-Benzodioxole-5-carbaldehyde |
| 90 | Helvetolide ®[7)] |
| 100 | Ionone Beta |
| 400 | Iso E ®[8)] Super |
| 200 | Phenoxy Isobutyrate |
| 10 | Isoeugenol |
| 250 | Iso alpha methylionone |
| 75 | Lyral ®[1)] |
| 20 | 10%* 2,6-Dimethyl-5-heptanal |
| 20 | 10%* 6-Methyl-5-hepten-2-one |
| 300 | Phenylhexanol |
| 200 | Salicynile ®[1)] |

-continued

| Parts by weight | Ingredient |
|---|---|
| 10 | 2,4-Dimethyl-3-cyclohexene-1-carbaldehyde |
| 40 | Gamma undecalactone |
| 5 | Vanilline |
| 4850 | |

*in dipropyleneglycol
[1)]3-methyl-2-hexenyl acetate[a)]
[2)]dodecahydro-3a,6,6,9a-tetramethyl-naphtho[2,1-b]furan[a)]
[3)]4-cyclohexyl-2-methyl-2-butanol[a)]
[4)](1'R,E)-2-ethyl-4-(2',2',3'-trimethyl-3'-cyclopenten-1'-yl)-2-buten-1-ol[a)]
[5)]pentadecenolide[a)]
[6)]Methyl cis-dihydrojasmonate[a)]
[7)](1S,1'R)-2-[1-(3',3'-dimethyl-1'-cyclohexyl)ethoxy]-2-methylpropyl propanoate[a)]
[8)]1-(octahydro-2,3,8,8-tetramethyl-2-naphthalenyl)-1-ethanone[b)]
9) 4/3-(4-hydroxy-4-methylpentyl)-3-cyclohexene-1-carbaldehyde[b)]
10) (2Z)-2-Phenyl-2-hexenenitrile[a)]
[a)]origin: Firmenich SA, Geneva, Switzerland
[b)]origin: International Flavors & Fragrances, USA The addition of 150 parts by weight of Composition 1 (as described herein above), as obtained in Example 1, to the above-described composition imparted to the latter a floral/fruity aspect, lifting the fruity note of ethyl-2-methylbutyrate, and adding an strong osmanthus character.

When instead of the invention's compound were used the same amount of Comparative Composition above described, the effect obtained was the addition of a green, hydrocarbon note bringing an imbalance in the fragrance which was also devoid of the lift and of the fruity, osmanthus character observed with the invention's Composition.

When instead of the invention's compound were used the same amount of 4-methyl-3-decen-5-ol (also known as Undecavertol; origin Givaudan SA, Vernier, Switzerland), the ionone note were lifted and the fragrance acquired a violet twist.

Example 3

Preparation of a Perfuming Composition

A perfuming composition for Eau de toilette for woman, of the floral-fruity type, was prepared by admixing the following ingredients:

| Parts by weight | Ingredient |
|---|---|
| 20 | Benzyl acetate |
| 10 | Ethyl acetoacetate |
| 10 | Allyl (3-methylbutoxy)acetate |
| 40 | 10%* Ambrox ®[1)] |
| 20 | 10%* Ethyl 2-methyl-pentanoate |
| 10 | Cascalone ®[2)] |
| 50 | Cassis Base ®[3)] |
| 40 | 10%* Cis-3-hexenol |
| 40 | Citronellol |
| 150 | Coranol ®[4)] |
| 20 | 10%* Damascenone |
| 10 | Gamma Decalactone |
| 100 | Dihydromyrcenol |
| 15 | 10%* Estragole |
| 190 | Exaltolide ®[5)] Total |
| 20 | 2-Methyl-4-(2,2,3-trimethyl-3-cyclopenten-1-yl)-4-penten-1-ol |
| 400 | 10%** Galaxolide ®[6)] |
| 130 | Geraniol |
| 400 | Hedione ®[7)] HC |
| 220 | 3-(1,3-benzodioxol-5-yl)-2-methylpropanal |
| 20 | Hivernal ®[8)] |
| 80 | Hydroxycitronellal |
| 10 | 10%* Indol |
| 170 | Iralia ®[9)] |

-continued

| Parts by weight | Ingredient |
|---|---|
| 15 | Jasminlactone |
| 380 | Lilial ®[10] |
| 100 | Linalol |
| 300 | Lyral ®[11] |
| 10 | 2,6-Dimethyl-5-heptanal |
| 10 | 10%* methyl 2-octynoate |
| 200 | Muscenone ®[12] Delta |
| 10 | 10%* Neobutenone ®[13] Alpha |
| 20 | 10%* Rose oxide |
| 50 | Phenethylol |
| 100 | Cis-3-Hexenyl salicylate |
| 5 | 2,4-Dimethyl-3-cyclohexene-1-carbaldehyde |
| 25 | Verdox ®[14] |
| 3400 | |

*in dipropyleneglycol
**in isopropyle myristate
[1]dodecahydro-3a,6,6,9a-tetramethyl-naphtho[2,1-b]furan[a]
[2]7-Isopropyl-2h,4h-1,5-benzodioxepin-3-one[a]
[3]compounded perfumery base[a]
[4]4-cyclohexyl-2-methyl-2-butanol[a]
[5]pentadecanolide[a]
[6]1,3,4,6,7,8-hexahydro-4,6,6,7,8,8-hexamethyl-cyclopenta-g-2-benzopyrane[b]
[7]Methyl dihydrojasmonate[a]
[8]3-(3,3/1,1-dimethyl-5-indanyl)propanal[a]
[9]mixture of methylionones isomers[a]
[10]3-(4-tert-butylphenyl)-2-methylpropanal[c]
[11]4/3-(4-hydroxy-4-methylpentyl)-3-cyclohexene-1-carbaldehyde[b]
[12]3-Methyl-5-cyclopentadecen-1-one[a]
[13]1-(5,5-dimethyl-1-cyclohexen-1-yl)-4-penten-1-one[a]
[14]2-tert-butyl-1-cyclohexyl acetate[b]
[a]origin: Firmenich SA, Geneva, Switzerland
[b]origin: International Flavors & Fragrances, USA
[c]origin: Givaudan-Roure SA, Vernier, Suisse The addition of 300 parts by weight of Composition 1 (as described herein above), as obtained in Example 1, to the above-described composition imparted to the latter a floral/fruity aspect in the direction of osmanthus/peony, marrying elegantly the rosy, jasmine notes of the composition.

When instead of the invention's compound were used the same amount of Comparative Composition above described, the effect obtained was the addition of a green, hydrocarbon note bringing an imbalance in the fragrance which was also devoid of the lift and of the floral/fruity character observed with the invention's Composition.

When instead of the invention's compound were used the same amount of 4-methyl-3-decen-5-ol (also known as Undecavertol; origin Givaudan SA, Vernier, Switzerland), the perfume's green, violet notes where boosted, without any fruity osmanthus twist.

Example 4

Preparation of a Perfuming Composition

A perfuming composition, of the apricot type, was prepared by admixing the following ingredients:

| Ingredient | Parts by weight |
|---|---|
| Butyl acetate | 160 |
| Hexyl acetate | 80 |
| (Z)-3-Hexen-1-ol acetate | 10 |
| Gamma nonalactone | 200 |
| Dihydro beta ionone | 600 |
| Amyl butyrate | 20 |
| Hexyl butyrate | 600 |
| (Z)-3-Hexen-1-ol butyrate | 10 |
| Hexyl caproate | 600 |
| (Z)-3-Hexen-1-ol caproate | 20 |

-continued

| Ingredient | Parts by weight |
|---|---|
| 3-Hydroxy-2-methyl-4(4h)-pyranone | 40 |
| Decal | 3000 |
| Dipropylene glycol | 700 |
| Dodecalactone | 800 |
| Gamma hexalactone | 40 |
| Gamma jasmolactone | 40 |
| Geraniol | 1000 |
| Linalool | 1000 |
| Gamma octalactone | 80 |
| Terpineol | 300 |
| Beta ionone | 300 |
| | 9600 |

The addition of 400 parts by weight of Composition 1 (as described herein above), as obtained in Example 1, to the above-described composition twisted the latter toward a juicier and fresher connotation by hiding the fatty aspect of the lactones and the dry aspect of the ionones and dihydro-beta-ionone.

Overall the perfuming composition containing Composition 1 gave the feeling of a fresh and juicy apricot while above perfuming composition (without Composition 1) gave more the feeling of a dried fruit.

Example 5

Preparation of a Perfuming Composition

A perfuming composition, of the osmanthus type, was prepared by admixing the following ingredients:

| Ingredient | Parts by weight |
|---|---|
| Dihydro beta ionone | 20 |
| Decal | 300 |
| Dipropylene glycol | 709 |
| (Z)-3-Hexen-1-ol isobutyrate | 1 |
| Linalol | 200 |
| Linalyl oxyide | 10 |
| Alpha ionone | 60 |
| Beta ionone | 300 |
| | 1600 |

The addition of 300 parts by weight of Composition 1 (as described herein above), as obtained in Example 1, to the above-described composition twisted the latter toward a more fruitier, lively connotation by hiding the fatty aspect of the lactones and the dry aspect of the ionones and dihydro-beta-ionone.

Overall the perfuming composition containing Composition 1 gave the feeling of a fresh osmanthus flower with even a morning dew effect while above perfuming composition (without Composition 1) gave more the feeling of a dried flower.

The invention claimed is:

1. A method of imparting odor notes of an osmanthus character to a perfuming composition or to a perfuming consumer product, which comprises adding to the perfuming composition or to the perfuming consumer product, a perfuming ingredient comprising:

at least 94% w/w of formula (I)

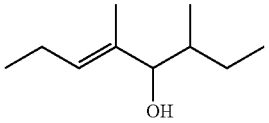

in the form of any one of its stereoisomers or a mixture thereof; and at most 1% w/w of 2-methylpent-2-en-1-ol and 3-ethyl-4-methylhexan-2-one wherein the percentages are expressed in a weight to weight basis relative to the total weight of said perfuming ingredient.

2. The method of claim 1, wherein the perfuming ingredient comprises:

at least 95% w/w of formula (I); and at most 0.8% w/w of 2-methylpent-2-en-1-ol and 3-ethyl-4-methylhexan-2-one.

3. The method of claim 1, wherein the perfuming ingredient comprises up to 99.9% w/w of compound (I).

4. The method of claim 1, wherein the perfuming ingredient comprises between 96% and 99% w/w E-4,6-dimethyl-3-octen-5-ol and less than 0.5% w/w of 2-methylpent-2-en-1-ol and 3-ethyl-4-methylhexan-2-one.

5. A perfuming composition comprising i) the perfuming ingredient of claim 1;

ii) at least one perfuming lactone and/or ionone;

iii) at least one ingredient selected from the group consisting of a perfumery carrier and a perfumery base; and optionally at least one perfumery adjuvant.

6. The perfuming composition according to claim 5, characterized in that said perfuming lactone is a $C_{5-12}$ monocyclic gamma lactones and is present in a w/w ratio matter of perfuming ingredient to lactones comprised between 2/1 and 1/20.

7. The perfuming composition according to claim 5, characterized in that said ionone is selected amongst alpha or beta ionone and alpha or beta di-hydro ionone and is present in a w/w ratio of perfuming ingredient to ionones comprised between 2/1 and 1/10.

8. The perfuming composition according to claim 5, wherein the perfuming lactone is present in a w/w ratio of perfuming ingredient to lactones comprised between 2/1 and 1/20; and wherein the ionone is present in a w/w ratio of perfuming ingredient to ionones comprised between 2/1 and 1/10.

9. A perfuming consumer product comprising the perfuming composition of claim 5.

10. A perfuming consumer product according to claim 9, characterized in that the perfumery consumer product is a perfume, a fabric care product, a body-care product, an air care product, a home care product, a leather care product or a car care product.

11. A perfuming consumer product according to claim 9, characterized in that the perfumery consumer product is a fine perfume, a splash or eau de perfume, a cologne or a shave or after-shave lotion, a liquid or solid detergent, a fabric softener, a fabric refresher, an ironing water, a paper, or a bleach, carpet cleaners, curtain-care products, a hair care product, a disinfectant, an intimate care product; a cosmetic preparation, a skin-care product, an air freshener, a "ready to use" powdered air freshener, a mold remover, furnisher care, wipe, a dish detergent or hard-surface detergent, a polish, waxes or plastic cleaners.

* * * * *